US005632516A

United States Patent [19]

Schwab

[11] Patent Number: 5,632,516

[45] Date of Patent: May 27, 1997

[54] MOTOR VEHICLE DOOR HANDLE

[75] Inventor: Dittmar Schwab, Rodgau, Germany

[73] Assignee: YMOS Aktiengesellschaft Industrieprodukte, Obertshausen, Germany

[21] Appl. No.: 664,968

[22] Filed: Jun. 10, 1996

[30] Foreign Application Priority Data

Jun. 9, 1995 [DE] Germany ..... 195 21 082.4

[51] Int. Cl.[6] ..... E05B 3/00

[52] U.S. Cl. ..... 292/336.3; 292/DIG. 31

[58] Field of Search ..... 292/336.3, 347, 292/DIG. 31

[56] References Cited

U.S. PATENT DOCUMENTS

| | | | |
|---|---|---|---|
| 3,993,338 | 11/1976 | Cherbourg et al. | 292/336.3 |
| 4,588,219 | 5/1986 | Kabayashi et al. | 292/DIG. 31 X |
| 4,681,357 | 7/1987 | Uemura et al. | 292/336.3 |
| 4,898,413 | 2/1990 | Bertolini | 292/336.3 |

FOREIGN PATENT DOCUMENTS

| | | | |
|---|---|---|---|
| 0194725 | 3/1986 | European Pat. Off. . | |
| 0458399 | 5/1991 | European Pat. Off. . | |
| 2237998 | 3/1973 | Germany | 292/336.3 |
| 3427178 | 7/1984 | Germany . | |
| 4239166 | 11/1992 | Germany . | |
| 19513249.1 | 8/1995 | Germany . | |

*Primary Examiner*—Rodney M. Lindsey
*Attorney, Agent, or Firm*—Spencer & Frank

[57] ABSTRACT

A motor vehicle door handle (1) with a base body (2) and a handle flap (18) which in its starting position partially covers an external handle recess (17), with the handle flap (18) being connected to one lever end (21) of each of two swivelling levers (6) which are pivotally mounted in an interior (3) of the vehicle door. In order for the handle flap (18) to fold back easily into an actuating position which favors gripping in a second end position (pull-out position) when the door is opened without the danger of injury in the hand area of the individual opening the door, the handle flap (18) is connected to each of the swivelling levers (6) by a respective lever-shaped arm (20) which can preferably be swivelled, only after reaching the pull-out position, against the direction of rotation of the swivelling lever (6) into an actuating position which favors gripping. In this case the swivelling motion of an arm (20) is preferably caused or supported by a pre-stressed torsion spring (23).

9 Claims, 4 Drawing Sheets

MOTOR VEHICLE DOOR HANDLE

REFERENCE TO RELATED APPLICATIONS

This application claims the priority of German application Serial No. 195 21 082.4, filed Jun. 9, 1995.

BACKGROUND OF THE INVENTION

The invention relates to a motor vehicle door handle comprising: a base body; a handle flap which in its starting position partially covers an external handle recess in the base body; a handle flap connected to one lever end of each of two swivelling levers which are pivotally mounted in the interior of a vehicle door so that said lever ends, in response to a corresponding actuating force on said door handle, are shifted to the outside against the force of a spring; and an actuating part which is coupled to at least one of said swivelling levers for movement therewith when said switching levers are moved in response to the actuation force, which is located in the interior of the door, and which can be connected to a lock actuator.

A door handle of the above type is known, for example, from EP 0458 399 B1. It consists of a handle flap which in the normal position partially covers an external handle recess, into which project one protruding end of each of two swivelling levers, which are pivotally mounted in the inside of the door. The swivelling levers are connected to a base body which is attached in the inside of the door. In order to be able to paint or touch up the door in the handle area even later without removing the entire base body with the swivelling levers and handle flap for this purpose, the handle flap is detachably connected to the ends of the swivelling levers. For this reason, the corresponding sleeve-shaped parts which are located on the handle flap are placed over the lever ends, with leaf springs located on the lever ends pressing against the sleeve-shaped parts of the handle flap.

In this known door handle it is disadvantageous above all that when pulling on the handle flap with the corresponding strength required, for example, for a tight lock, the lever flap is relatively easily pulled off of the swivelling lever ends again so that the vehicle door cannot be opened in this case. Moreover, in this known handle the handle flap in its starting position is relatively far from the outside wall of the motor vehicle door, which is undesirable. Rather, for aesthetic reasons, as well as for reasons of good road behavior of the corresponding motor vehicle door, the handle flap in its starting position should cover the handle recess flush.

From DE 42 39 166 A1 a motor vehicle door handle of the generic type is known, in which, for purposes of high force transmission from the actuating hand to the door handle, it is suggested that a handle rod be placed on the bottom end of the handle flap. If, in order to open the vehicle door, it is necessary to reach behind the handle flap, it swivels forward into a position which favors gripping so that the actuating hand can almost entirely surround the handle rod.

In this known door handle it is disadvantageous mainly that the handle flap which is tilted toward the corresponding actuating hand when opening the door is frequently troublesome and causes an increase of the danger of injury in the area of the hand of the individual opening the door.

Finally, German patent DE 195 13 249.1 C1 discloses a motor vehicle door handle in which the door flap and the ends of the swivel lever are interconnected via clip-like catch connections as well as via pins, with the pins each fitting into a recess of the two side parts of the handle flap or the swivelling levers so that after loosening the clip-like catch projection, the handle flap can be swivelled around the respective pin against the direction of rotation of the swivel lever into an actuating position which favors gripping.

To move the handle into the position for initiating high force transmission (pull-off position) the handle flap is first swivelled out into the catch position. Then, continuing to pull releases the clip connection. The handle flap can then be swivelled downward so that at this point it can be encompassed by the actuating hand from the top and pulled with correspondingly high force.

In these door handles it is disadvantageous above all else that it is relatively difficult to fold the handle flap back into the pull-off position.

SUMMARY OF THE INVENTION

The object of the invention is to devise a motor vehicle door handle of the initially mentioned type, in which in the pull-off position the handle flap easily folds back into an actuating position which favors gripping without the danger of injury in the hand area of the individual opening the door.

A motor vehicle door handle which comprises: a base body; a handle flap which, in its starting position, partially covers an external handle recess in the base body; a handle flap connected to one lever end of each of two swivelling levers which are pivotally mounted in the interior of a vehicle door so that these lever ends, in response to a corresponding actuating force on the door handle, are shifted to the outside against the force of a spring; and an actuating part which is coupled to at least one of the swivelling levers for movement therewith when the switching levers are moved in response to the actuation force, which is located in the interior of the door, and which can be connected to a lock actuator; and wherein: the handle flap is connected to the ends of the swivelling levers via respective lever-shaped arms; each respective lever-shaped arm is mounted to be swivelled around a respective axis, which is located on the end of a respective swivelling lever, against the direction of rotation of the respective swivelling lever into an actuating position which favors gripping; and the base body has a running guide contour which engages and guides an edge of a respective lever-shaped arm when the handle flap is pulled out of the starting position into a second end position (pull-out position) during a stipulated swivelling path segment such that the arm can be swivelled into the actuating position which favors gripping only after reaching the end of the stipulated swivelling path segment. Other special advantageous features of the invention are disclosed.

The invention is based essentially on the idea of joining the handle flap to each of the swivelling levers by a respective lever-shaped arm which can be swivelled, preferably after reaching the pull-off position, against the direction of rotation of the swivelling lever into an actuating position which favors gripping. In doing so, the swivel motion of the arm is preferably caused by a prestressed torsion spring.

Moreover, in order to easily achieve that the handle flap remains in the pull-off position to be encompassed by the hand from overhead, the end of the arm facing away from the handle flap is formed as a clamp part or catch part such that after the swivelling motion of the arm into the actuating position which favors gripping, the clamp part or catch part forms a clamp connection or catch connection with the base body of the door handle.

In one advantageous embodiment, the swivelling arm is connected, via a coupling spring which is significantly stronger than the return spring of the swivelling lever, to an actuating lever which for its part is connected to the lock via a rod or a Bowden cable. Both the swivelling and actuating levers can be supported to swivel around the same axis of rotation so that when the handle flap is pulled, the swivelling lever and the actuating lever both swivel in the same direction. After a stipulated swivelling path, the actuating lever pushes against a stop of the housing and can no longer be further swivelled (pulled position of the handle flap). The maximum swivelling path of the actuating lever is thus selected such that the lock can be unlocked and the motor vehicle door can be opened conventionally.

If, on the other hand, the door sticks in the door frame, the handle flap, and thus also the swivelling lever, can be further swivelled to the outside—not conversely the actuating lever—until the handle flap is in the pull-off position. In this case, the coupling spring is tensioned between the swivelling and actuating levers.

To ensure that the door can also be opened if the door lock sticks, in one advantageous embodiment the swivelling lever and/or the actuating lever have a cam or follower arrangement. This results in the fact that when the actuating lever is blocked, the handle flap can first be swivelled out of the handle recess and the cam or follower arrangement of the swivel lever, after compressing the coupling spring located between the swivelling and actuating levers, presses directly against the actuating lever and entrains it.

In order to be able to mount and dismount the handle flap from the outside, according to another advantageous feature of the invention, a spring-operated, swivelling, hook-shaped catch lever is located on the base body and position such that, in the pull-off position it keeps the swivelling lever in the swivelled-out position.

Other details and advantages of the invention arise from the following using the embodiment explained by the Figures.

DETAILED DESCRIPTION OF THE PREFERRED EMBODIMENT

Figure 1:
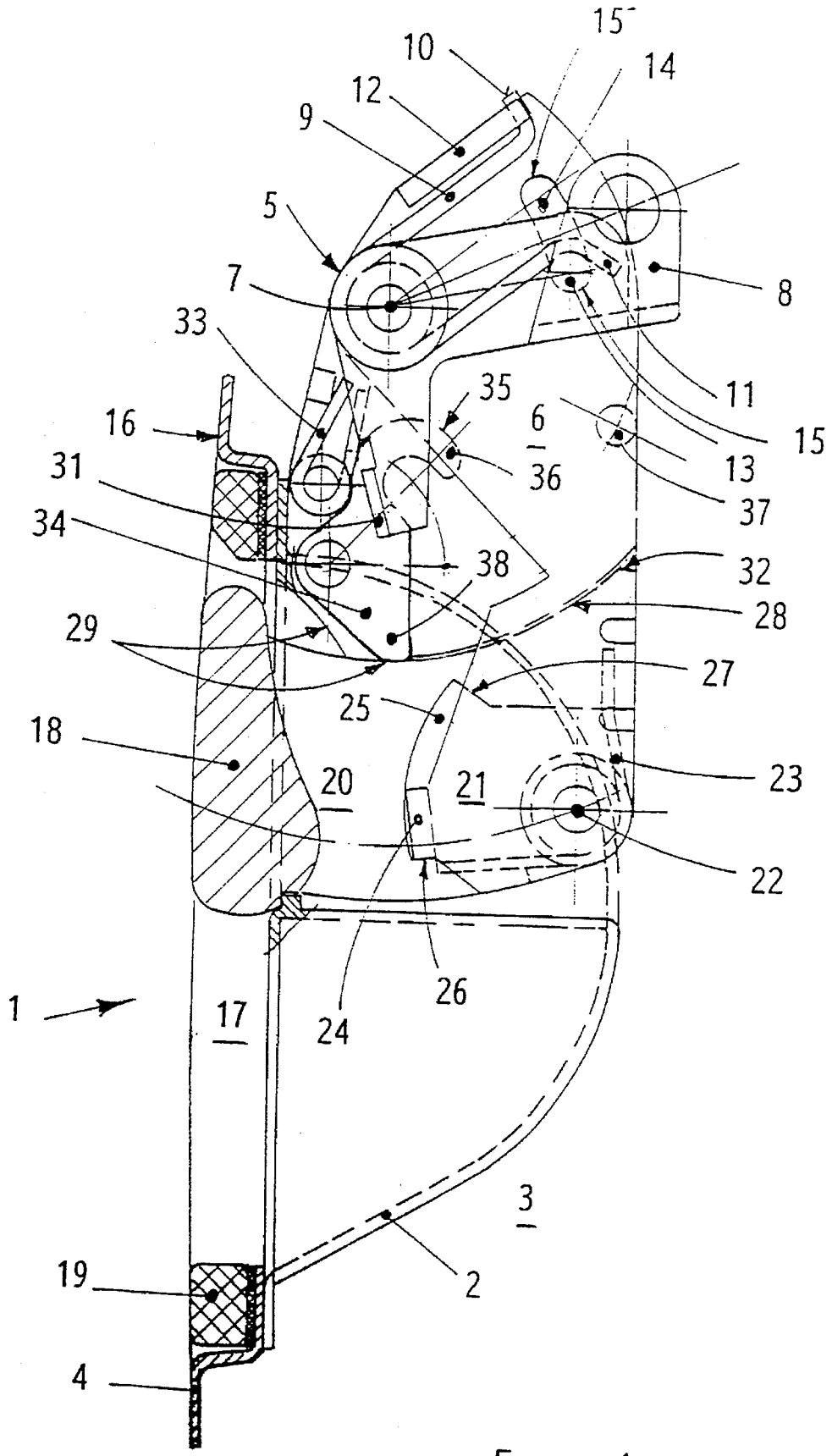
FIG. 1 shows the cross section of a door handle according to the invention in the area of one of the two swivelling levers in the starting position.

In FIG. 1 the door handle is labelled 1, and contains a base body 2 which is attached from interior 3 of a motor vehicle door to a section of door shell 4 which is cavity-shaped to the inside. In the upper area of base body 2 there is a bracket 5 in which one end of one of a pair of swivelling lever 6 (only one of which can be seen in the Figure) is supported to swivel around axis of rotation 7 and is pulled into its illustrated starting position by a torsion spring which is not shown.

Likewise, an actuating lever 8 which can be joined to a lock actuator which is not shown, for example via a rod or Bowden cable, is supported to swivel in bracket 5 around the axis of rotation 7. Actuating lever 8 and swivelling lever 6 are joined to one another via a coupling or leg spring 9. For this purpose, the ends 10, 11 of leg spring 9 are supported respectively on a cam 12 of the swivelling lever 6 and on a journal or bearing rod 13 disposed on the actuating lever 8. Journal 13 moreover fits into a longitudinal hole 14 formed in the swivelling lever 6, with journal 13 being supported on one end 15 of longitudinal hole 14 when the lever 6 is in its illustrated position.

On the outside 16 of the vehicle door in the area of handle recess 17 there are a handle flap 18 and a cover frame 19. To join handle flap 18 and the respective ends of the swivelling levers 6, a respective lever-shaped arm 20 is permanently connected to handle flap 18 and is supported to swivel around an axis 22 which is located on a respective end 21 of the swivelling lever 6. In this case, the swivelling process of arm 20 relative to swivelling lever 6 is supported by a torsion spring 23. To limit the swivel motion of a respective arm 20, the end 21 of a respective swivelling lever 6 is provided with a journal 24 which can be swivelled or moved along a guide recess 25 contained in the associated arm 20, with the recess 25 having two stops 26, 27.

Each respective lever-shaped arm 20 is moreover bounded on its upper edge 28 by guide (running contour) 29 of base body 2 so that arm 20 is guided by form-fit during a stipulated swivel path segment when handle flap 18 is pulled out and arm 20 cannot be swivelled around axis 22 against swivelling lever 6.

Figure 2:
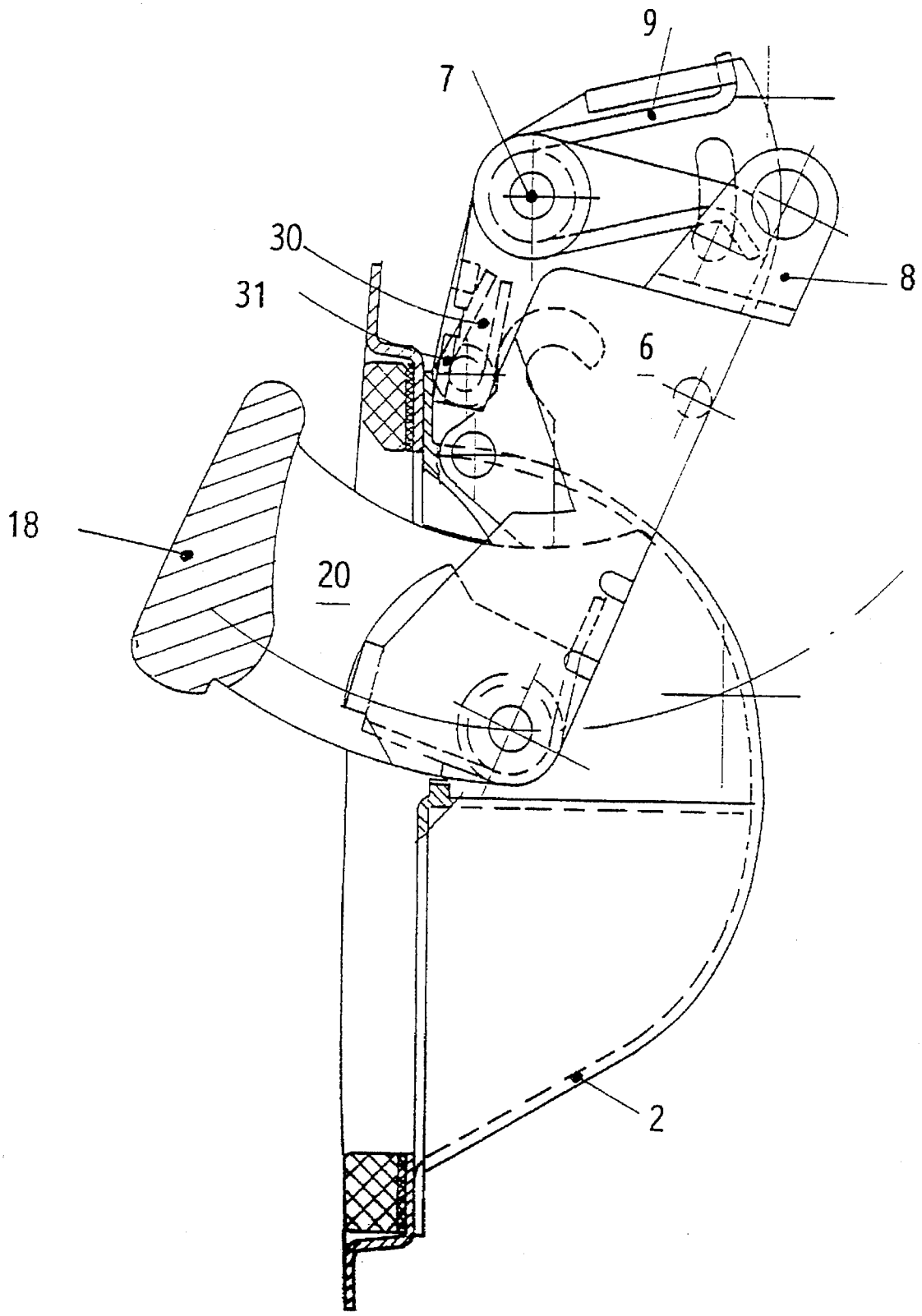
FIG. 2 shows the door handle shown in FIG. 1 in its pulled position.

In the following, the sequence of functions which occur when handle flap 18 is actuated is detailed. When handle flap 18 is pulled out of the position shown in FIG. 1, swivelling lever 6 is actuated via lever-shaped arm 20. Swivelling lever 6 turns around axis 7 and entrains actuating lever 8 via leg spring 9. After swivelling lever 6 and thus also actuating lever 8 are swivelled by a stipulated angle $\alpha$ (for example, 10° to 25°,) actuating lever 8 with stop 31 located on its end 30 strikes base body 2 (see FIG. 2) so that further swivelling of actuating lever 8 is not possible. The door opens and the opening process is generally ended.

Figure 3:
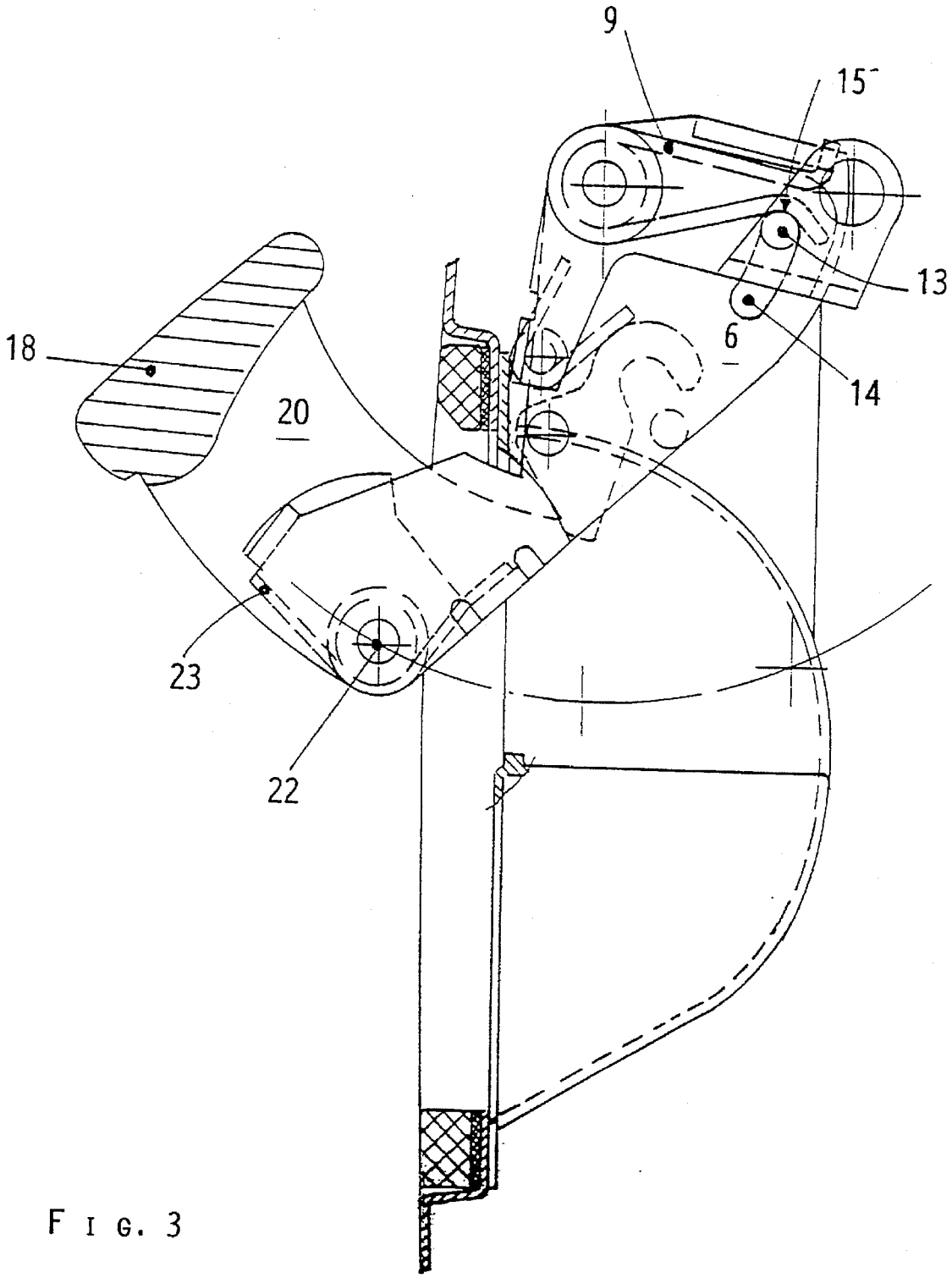
FIG. 3 and FIG. 4 show the door handle shown in FIG. 1 in its tear-off position before and after folding the flap handle back into the position which favors gripping.
Figure 4:
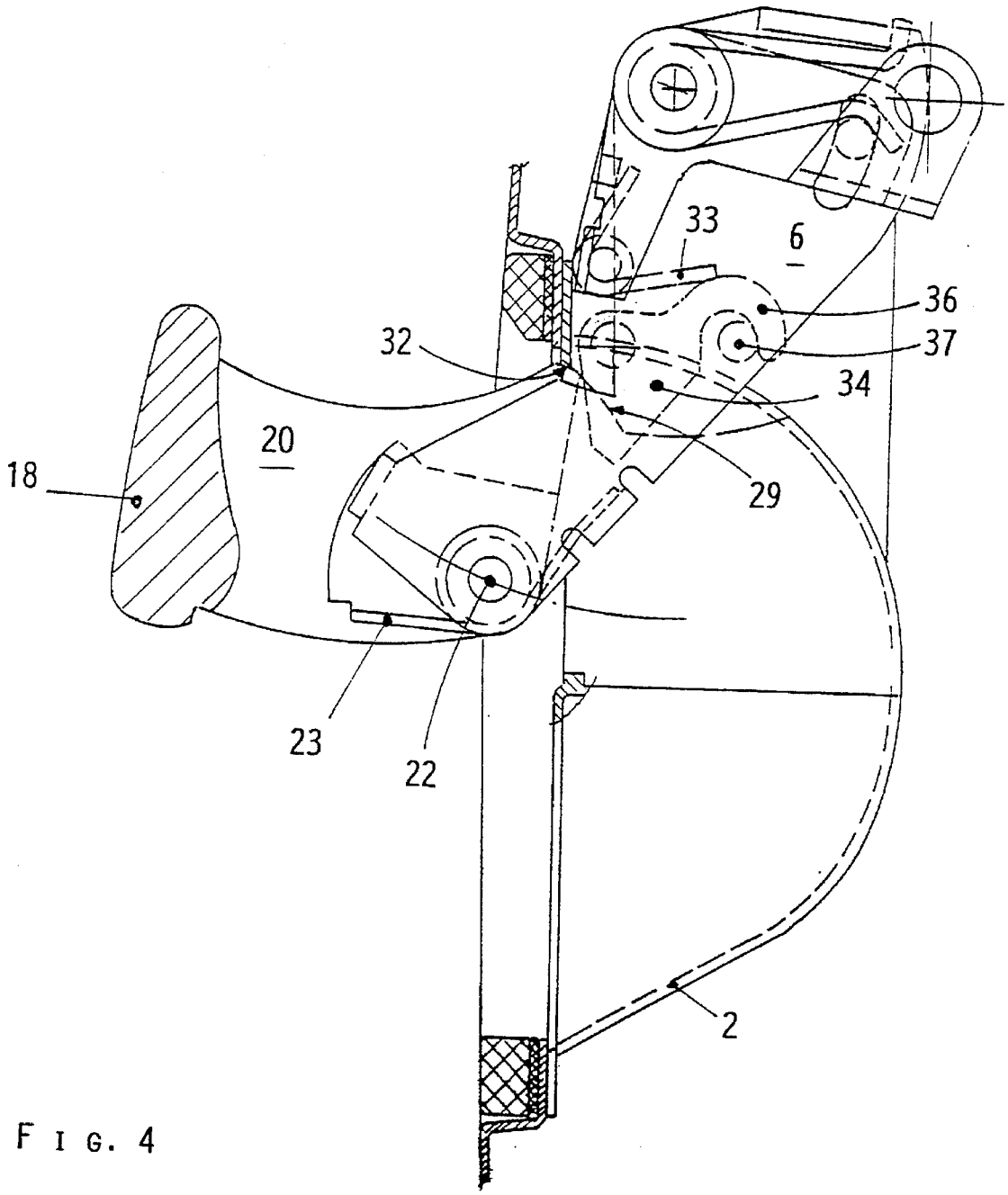

If the door cannot be opened although actuating lever 8 has completed the entire swivelling path and via its stop 31 strikes base body 2, handle flap 18 can be pulled farther outward. In this case leg spring 9 is compressed and journal 13 of actuating lever 8 is moved in longitudinal hole 14 of swivelling lever 6 in the manner of a follower. The swivelling lever 6 can be pulled outward via handle flap 18 until journal 13 moving in longitudinal recess or opening hole 14 strikes its end 15' (FIG. 3). In this position, based on the curve of running contour 29, handle flap 18 is simultaneously released to swivel around axis 22 via torsion spring 23 so that the spring swivels arm 20 with handle flap 18 downward into a position which favors gripping (FIG. 4).

In order that handle flap 18 not be pulled back into base body 2, arm 20 with its end 32 is supported on running contour 29 of base body 2 and forms a clamping joint. If handle flap 18 is to be moved back again into its starting position (FIG. 1), it must be swivelled around axis 22 against the force of torsion spring 23 until the edge 32 of the respective arm 20 of handle flap 18 is again swivelled into contact with the running contour 29 of base body 2.

In order to be able to mount/dismount handle flap 18 from the outside 16 of the vehicle door, a catch lever 34 is mounted on the base body 2 so that it can be swivelled, so that it is driven by spring 33, and so that in the pull-out position (FIG. 4) can engage and keep swivel lever 6 in the swivelled-out position. For this purpose a first end 35 of catch lever 34 has a hook-shaped catch projection 36 which in the pull-out position of lever 6 can engage and encircle a journal or bearing rod 37 which is located on the swivel lever 6. With its second end 38, catch lever 34 is supported on edge (running surface) 28 of arm 20 of handle flap 18 so that catch lever 34 can only swivel when handle flap 18 is in the pull-out position.

The invention now being fully described, it will be apparent to one of ordinary skill in the art that any changes and modifications can be made thereto without departing from the spirit or scope of the invention as set forth herein.

What is claimed is:

1. Motor vehicle door handle comprising: a base body; a handle flap which in its starting position partially covers an external handle recess in the base body; the handle flap connected to one lever end of each of two swivelling levers which are for pivotal mounting in the interior of a vehicle door so that said lever ends, in response to a corresponding actuating force on said handle flap, are shifted to the outside of the door against the force of a spring; and an actuating part which is coupled to at least one of said swivelling levers for movement therewith when said swivelling levers are moved in response to the actuation force, which is for locating in the interior of the door, and which is connectable to a lock actuator; and wherein said handle flap is connected to said swivelling levers via respective lever-shaped arms;

each respective lever-shaped arm is mounted to be swivelled around a respective axis, which is located on said end of a respective swivelling lever, against a direction of rotation of the respective swivelling lever into an actuating position which favors gripping; and said base body has a running guide contour which engages and guides an edge of a respective lever-shaped arm when said handle flap is pulled out of the starting position into a second end position or pull-out position during a stipulated swivelling path segment such that said arm can be swivelled into the actuating position which favors gripping only after reaching the end of the stipulated swivelling path segment.

2. Motor vehicle door handle according to claim 1, wherein each said guide contour of said base body is selected such that the respective said arm can be swivelled into the actuating position which favors gripping only after reaching a pulled position, in which a lock of the motor vehicle door is opened by the lock actuator, of said handle flap.

3. Motor vehicle door handle according to claim 1, wherein each said guide contour of said base body is selected such that the respective said arm can be swivelled into the actuating position which favors gripping only when said second end position or pull-out position of said handle flap is reached.

4. Motor vehicle door handle according to claim 1 further comprising a respective torsion spring mounted on one of said swivelling levers for swivelling the respective said arm into the actuating position which favors gripping.

5. Motor vehicle door handle according to claim 1 further comprising means for limiting the swivelling movement of a respective said arm relative to the associated respective swivelling lever comprising a bearing rod disposed on the respective swivelling lever at its respective said end and engaging in a guide recess, having two end stops, contained in the respective said arm.

6. Motor vehicle door handle according to claim 1, wherein an end of each said arm facing away from said handle flap is formed as a clamp part or a catch part which forms a clamp connection or a catch connection with said base body after the swivelling of said arm into the actuating position which favors gripping to hold the respective said arm in its swivelled position.

7. Motor vehicle door handle according to claim 1, wherein: said actuating part is a lever which is supported to swivel around the same axis of rotation as at least one of said swivelling levers; a coupling spring interconnects said swivelling lever and said actuating lever so that when said handle flap is pulled, said swivelling lever and said actuating lever both swivel in the same direction; a swivelling path of said actuating lever is less than that of said swivelling lever so that after reaching the pulled-out position of said handle flap, said actuating lever is blocked and said coupling spring is tensioned for further swivelling of said swivelling lever into the pull-out position.

8. Motor vehicle door handle according to claim 7, wherein at least one of said swivelling levers and said actuating lever is provided with a cooperating member arranged such that when a lock is blocked after compression of said coupling spring, said actuating lever is entrained by at least one of said swivelling levers.

9. Motor vehicle door handle according to claim 1, further comprising: means for maintaining the swivelling lever in the swivelled-out position when the door handle is in the pull-out position, said means including spring-operated, swivelling, hook shaped catch lever mounted on said base body adjacent said swivelling lever, said catch lever having a first end with a hook-shaped catch projection which encircles a bearing rod located on said swivelling lever when said swiveling lever is in the pull-out position, and wherein said catch lever has a second end which is supported on said edge of said arm so that said catch lever can only swivel when said handle flap is in the pull-out position.

* * * * *